US009718205B1

(12) United States Patent
Britton

(10) Patent No.: US 9,718,205 B1
(45) Date of Patent: Aug. 1, 2017

(54) SINGLE SETUP SHAPER SANDER

(71) Applicant: VOORWOOD COMPANY, Anderson, CA (US)

(72) Inventor: Adam Britton, Chico, CA (US)

(73) Assignee: VOORWOOD COMPANY, Anderson, CA (US)

( * ) Notice: Subject to any disclaimer, the term of this patent is extended or adjusted under 35 U.S.C. 154(b) by 90 days.

(21) Appl. No.: 13/971,798

(22) Filed: Aug. 20, 2013

Related U.S. Application Data

(60) Provisional application No. 61/691,069, filed on Aug. 20, 2012.

(51) Int. Cl.

| | |
|---|---|
| ***B26D 7/27*** | (2006.01) |
| ***B24B 19/00*** | (2006.01) |
| ***B27C 9/04*** | (2006.01) |
| ***B24B 41/06*** | (2012.01) |
| ***B24B 27/02*** | (2006.01) |
| ***B24B 3/08*** | (2006.01) |
| *B24B 41/02* | (2006.01) |

(52) U.S. Cl.
CPC ..... *B26D 7/27* (2013.01); *B24B 3/085* (2013.01); *B24B 19/009* (2013.01); *B24B 27/02* (2013.01); *B24B 41/068* (2013.01); *B27C 9/04* (2013.01); *B24B 41/02* (2013.01)

(58) Field of Classification Search
CPC ..... B23Q 3/157; B24B 27/02; B24B 41/02; B24B 41/04; B24B 41/068; B24B 3/085; B24B 17/00; B24B 17/023; B24B 19/009; B26D 7/27; B27C 9/04; B28D 1/003
See application file for complete search history.

(56) References Cited

U.S. PATENT DOCUMENTS

| | | | | | |
|---|---|---|---|---|---|
| 3,561,908 | A * | 2/1971 | Reinfeld | B23B 5/40 | 451/236 |
| 4,161,974 | A * | 7/1979 | Patterson | B23D 45/021 | 108/142 |
| 4,660,539 | A * | 4/1987 | Battaglia | B24B 7/005 | 125/10 |
| 4,685,180 | A * | 8/1987 | Kitaya | B24B 9/10 | 29/33 R |
| 5,558,565 | A * | 9/1996 | Dedonato | B23Q 35/104 | 225/96 |
| 5,865,228 | A * | 2/1999 | Patterson | B25H 1/0042 | 144/1.1 |
| 6,006,735 | A * | 12/1999 | Schlough | B24B 9/06 | 125/13.01 |

(Continued)

*Primary Examiner* — Timothy V Eley
(74) *Attorney, Agent, or Firm* — O'Banion & Ritchey LLP; John P. O'Banion

(57) ABSTRACT

A single station shaper sander that uses a quick change retractable shaper and a quick change retractable profile sander is described. The shaper generates a profile in a substrate, and then the sander sands the profile in the substrate without intermediate removal of the substrate. Both the shaper and sander are retractable, moving away from the substrate when retracted, and are moved into contact with the substrate when engaged. Either an operator or automatic controls may be used to engage and retract the shaper or sander, so as to minimize operator access to dangerous moving surfaces on either. Further, each sander or shaper may have removable tools that are temporarily affixed to a spindle, affording tool changes of 15 seconds or less.

17 Claims, 24 Drawing Sheets

(56) References Cited

U.S. PATENT DOCUMENTS

| | | | | |
|---|---|---|---|---|
| 6,865,787 | B2 * | 3/2005 | Shingai | B23B 5/00 29/28 |
| 8,550,874 | B2 * | 10/2013 | Bando | B24B 9/102 451/11 |
| 2008/0115640 | A1 * | 5/2008 | Ranner | B23D 45/003 83/98 |
| 2010/0154933 | A1 * | 6/2010 | Hatch, Jr. | B27C 5/04 144/360 |

* cited by examiner

Engaged Engaged

Retracted Engaged

SINGLE SETUP SHAPER SANDER

CROSS-REFERENCE TO RELATED APPLICATIONS

This application is a nonprovisional of U.S. provisional patent application Ser. No. 61/691,069 filed on Aug. 20, 2012, which is incorporated herein by reference in its entirety.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

NOTICE OF MATERIAL SUBJECT TO COPYRIGHT PROTECTION

A portion of the material in this patent document is subject to copyright protection under the copyright laws of the United States and of other countries. The owner of the copyright rights has no objection to the facsimile reproduction by anyone of the patent document or the patent disclosure, as it appears in the United States Patent and Trademark Office publicly available file or records, but otherwise reserves all copyright rights whatsoever. The copyright owner does not hereby waive any of its rights to have this patent document maintained in secrecy, including without limitation its rights pursuant to 37 C.F.R. §1.14.

BACKGROUND OF THE INVENTION

1. Field of the Invention

This invention pertains generally to shaping stations, more particularly to shaping stations that allow shaping and sanding in consecutive operations with a single substrate setup, and still more particularly to shaping and sanding stations that allow for any number of sanding passes with a single substrate setup.

2. Description of Related Art

Typically, shaping requires generation of a profile, then sanding of the profile to a desired degree of smoothness. This is commonly done by hand sanding, and typically done at a location different from the profiling so that the sanding station is not uselessly occupied.

BRIEF SUMMARY OF THE INVENTION

The present invention is a shaper sander station comprising a retractable shaper and a retractable sander. The retractable shaper generates a profile in a substrate and then retracts from the substrate. The retractable sander then sands the profile in the substrate. This is accomplished without the need for removal of the substrate between the shaping and sanding steps.

Accordingly, an aspect of the invention is a shaper sander apparatus. In one embodiment, the apparatus comprises a frame; a shaper attached to the frame, the shaper having a shaper engaged position; and a sander attached to the frame, the sander having a sander engaged position. The shaper is configured to cut a profile in a substrate when the shaper is in the shaper engaged position, and the sander is configured to thereafter sand the profile in the substrate when the sander is in the sander engaged position. The apparatus allows for shaping and sanding the substrate without intermediate removal of the substrate. Sanding may require from one to many passes, and perhaps even different sanding grits as a customer requires.

Another aspect of the invention is a shaper sander station. In one embodiment, the shaper sander station comprises a frame; means for shaping a profile, said means for shaping attached to the frame; and means for sanding the profile, said means for sanding attached to the frame.

A still further aspect of the invention is an improved method for shaping and sanding a substrate. In one embodiment, the method comprises providing a retractable shaper; providing a retractable profile sander; initially mounting a substrate; shaping a profile into the substrate with the retractable shaper, and then retracting the retractable shaper; and then sanding the profile previously shaped in the substrate with the retractable profile sander. In this method, the substrate may be mounted on a slide assembly just once during the shaping of one edge. Also in this method, the retractable shaper may be removable and replaceable to allow for different cutting profiles in the substrate. Furthermore, the retractable profile sander may be removable and replaceable to allow for different sanding profiles in the substrate, or different grits of sander.

In another embodiment, a method for shaping and sanding a substrate may comprise: providing a retractable shaper and a retractable profile sander; positioning the retractable shaper in a shaper engaged position; positioning the retractable sander in a sander engaged position; moving the substrate past the retractable shaper to generate a profile in the substrate; retracting the retractable shaper to a shaper retracted position; and sanding the profile in the substrate with the retractable sander; whereby the substrate is only removed after the profile has been cut and sanded.

In a still further embodiment, a method of shaping and sanding may comprise: providing a retractable shaper; providing a retractable sander; initially mounting a substrate; then shaping a profile into the substrate with the retractable shaper, then retracting the retractable shaper; and finally, sanding the profile previously shaped in the substrate with the retractable profile sander.

Further aspects and embodiments of the invention will be brought out in the following portions of the specification, wherein the detailed description is for the purpose of fully disclosing preferred embodiments of the invention without placing limitations thereon.

BRIEF DESCRIPTION OF THE SEVERAL VIEWS OF THE DRAWING(S)

The invention will be more fully understood by reference to the following drawings which are for illustrative purposes only:

Figure 5A:
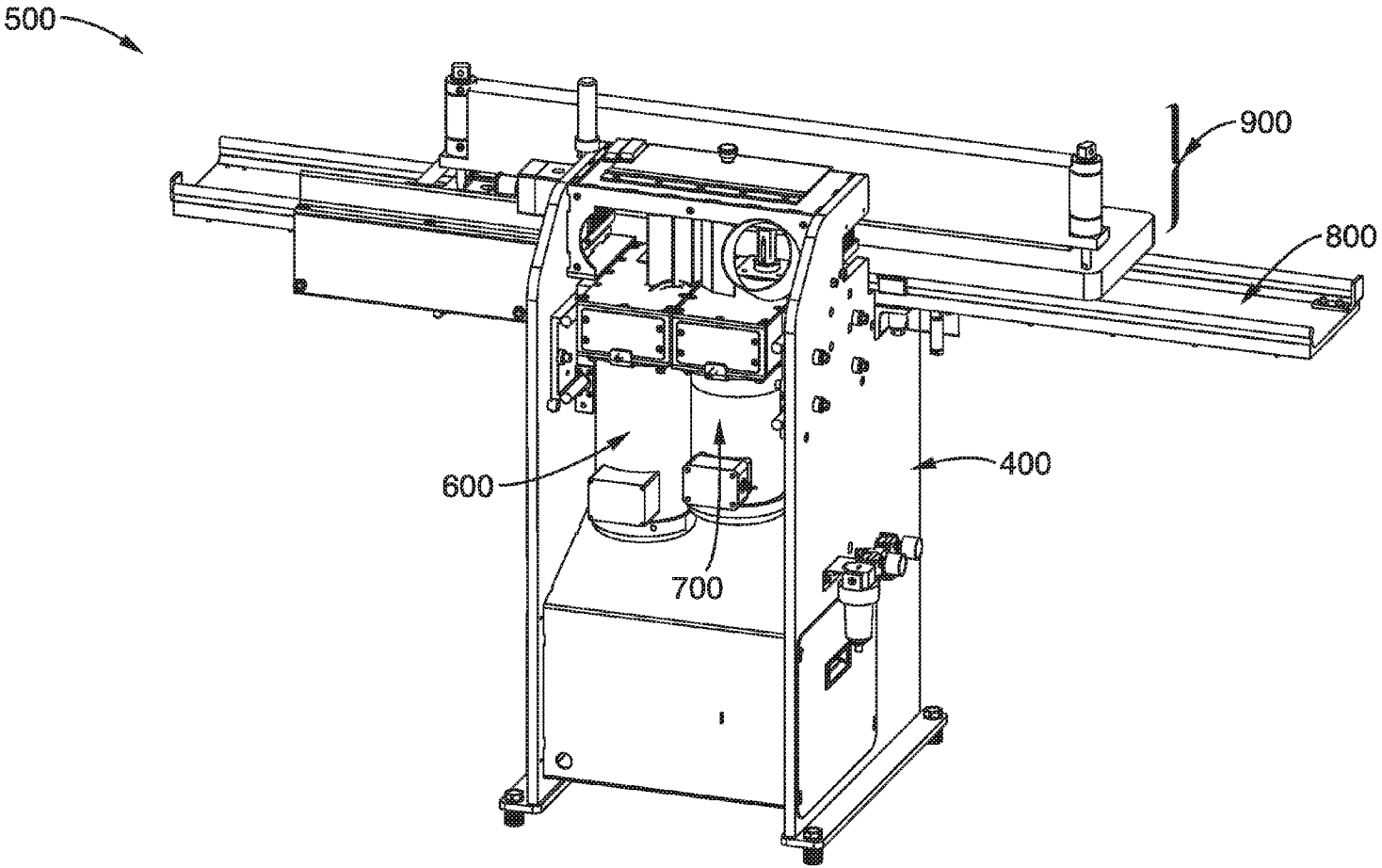
FIG. 5A is a rear isometric view of the single setup shaper sander, which uses the modified frame of FIG. 4A through FIG. 4C to allow for simultaneous mounting of both a retractable quick change shaper and a retractable quick change sander, and shows the major subassemblies present.
Figure 5B:
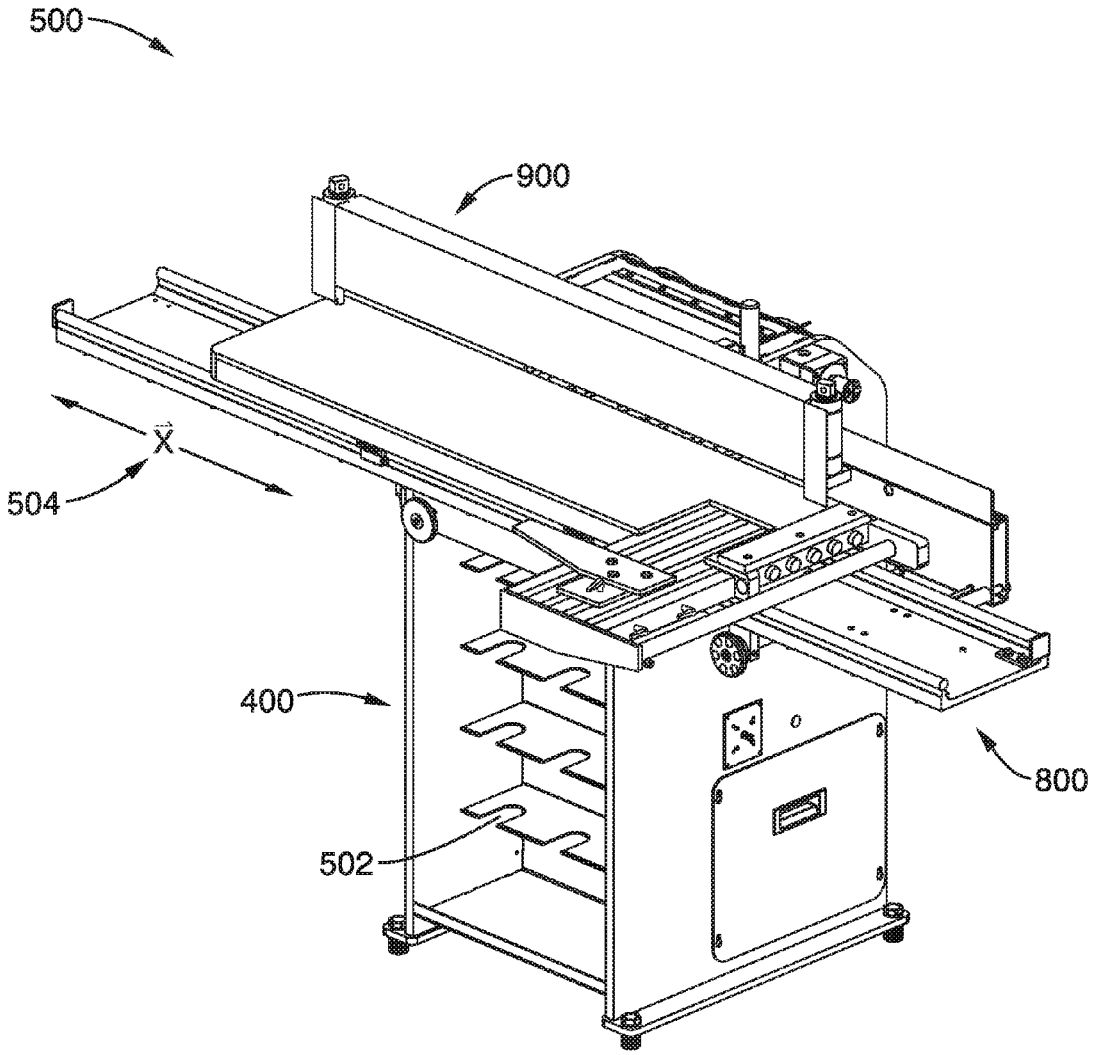
FIG. 5B is a front isometric view of the single setup shaper sander of FIG. 5A.
Figure 5C:
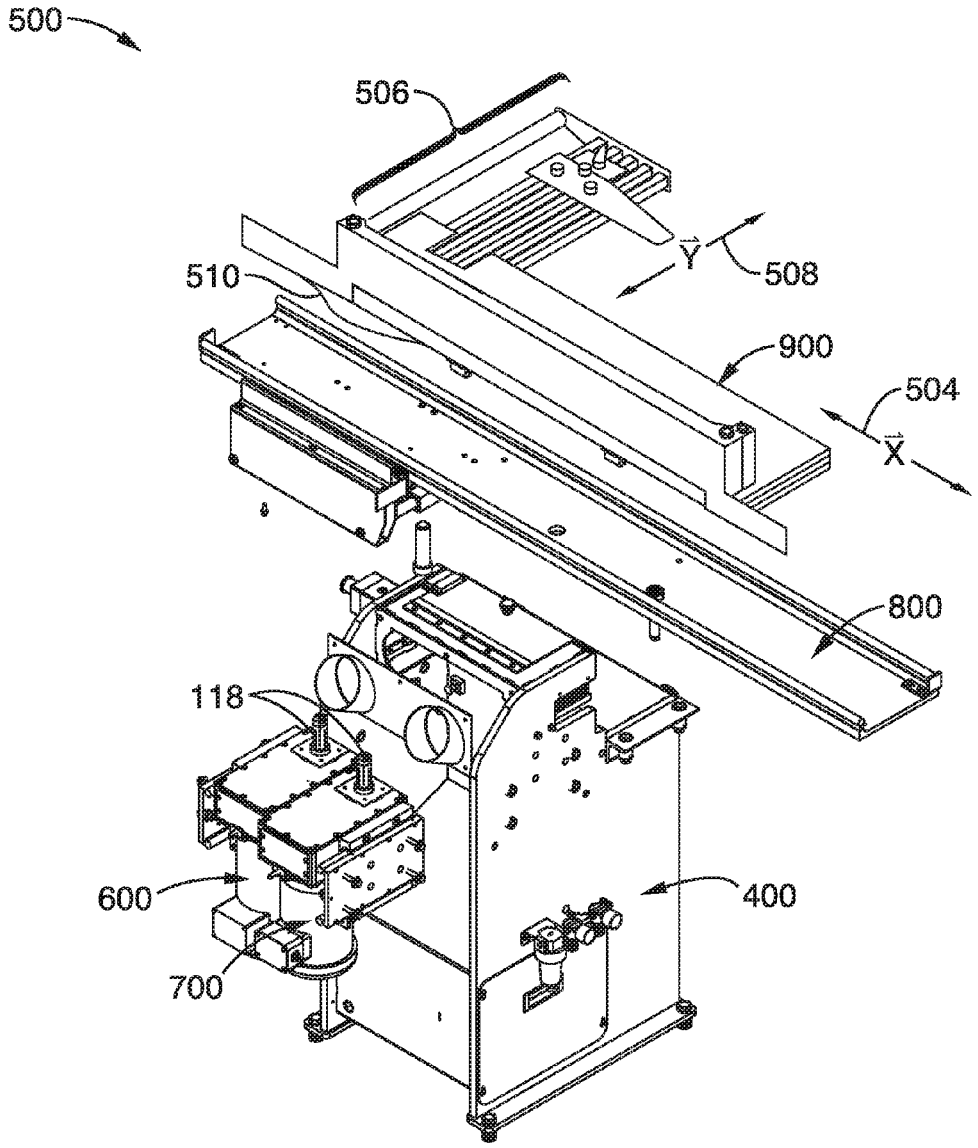
FIG. 5C is a partially exploded rear isometric view of the single setup shaper sander of FIG. 5A and FIG. 5B, where a quick change retractable shaper, a quick change retractable sander, a rail assembly, and a sliding table assembly are shown, and where an optional size square assembly is shown mounted to the sliding table assembly.
Figure 10A:
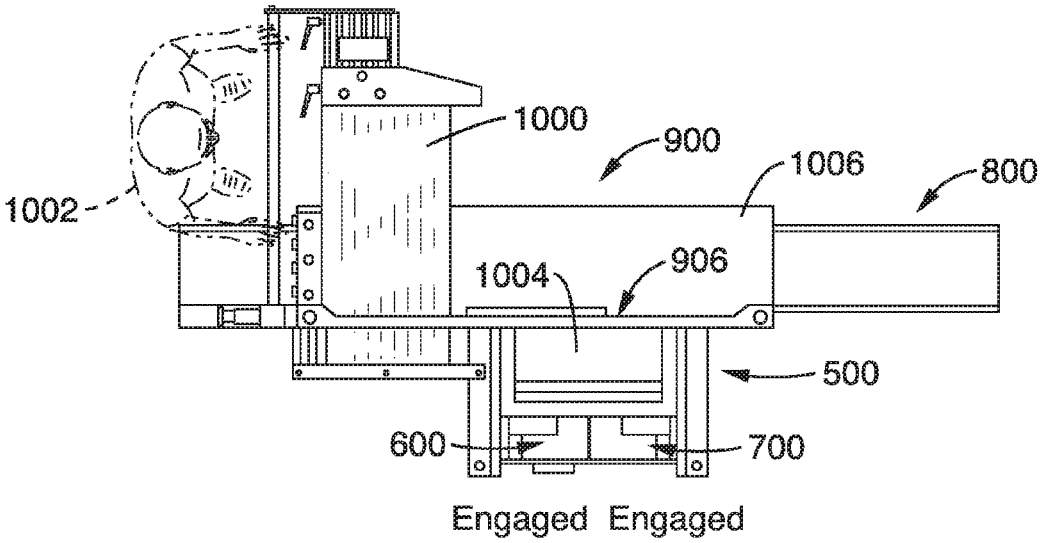
FIG. 10A is a top view of the single setup shaper sander 500 previously described in FIG. 5A through FIG. 5C, where a cover plate protects the shaper and sander from ejecting sawdust to the operator.
Figure 10B:
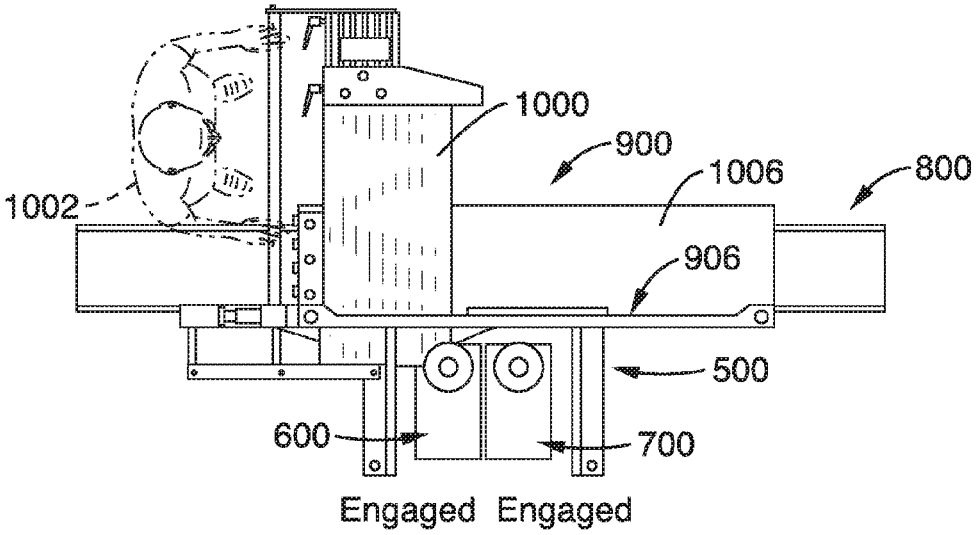
FIG. 10B is a top view of the single setup shaper sander 500 previously described in FIG. 5A through FIG. 5C, where an operator has engaged the retractable quick change shaper assembly and the retractable quick change sander assembly so that a substrate may be shaped and subsequently sanded.
Figure 10C:
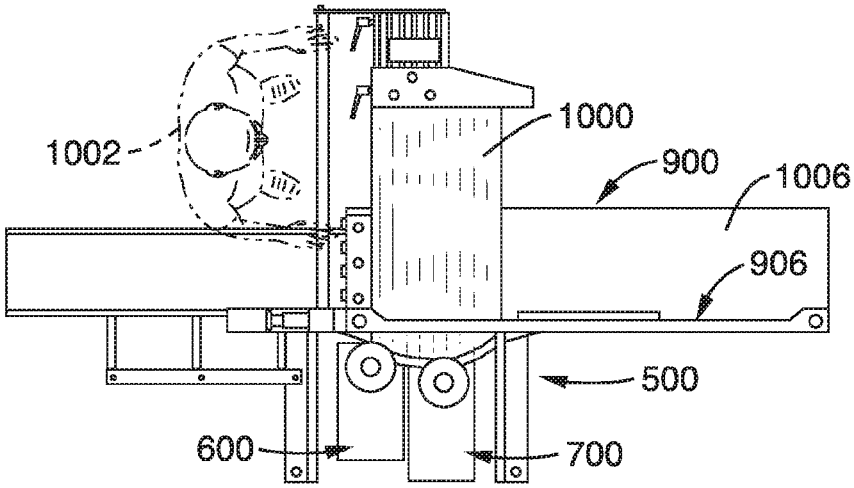
Figure 10D:
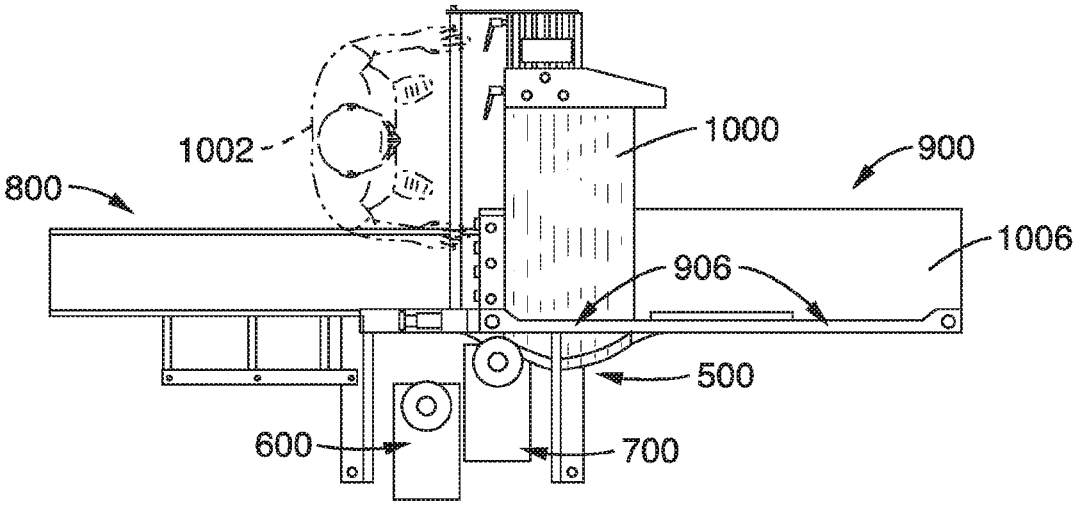

FIG. 10C is a top view of the single setup shaper sander 500 previously described in FIG. 5A through FIG. 5C, where an operator is beginning to shape and sand a substrate in a single setup FIG. 10D is a top view of the single setup shaper sander 500 previously described in FIG. 5A through FIG. 5C, where an operator has completed shaping a substrate, and is nearly finished sanding the substrate in the same pass, and still in a single setup.

Figure 10E:
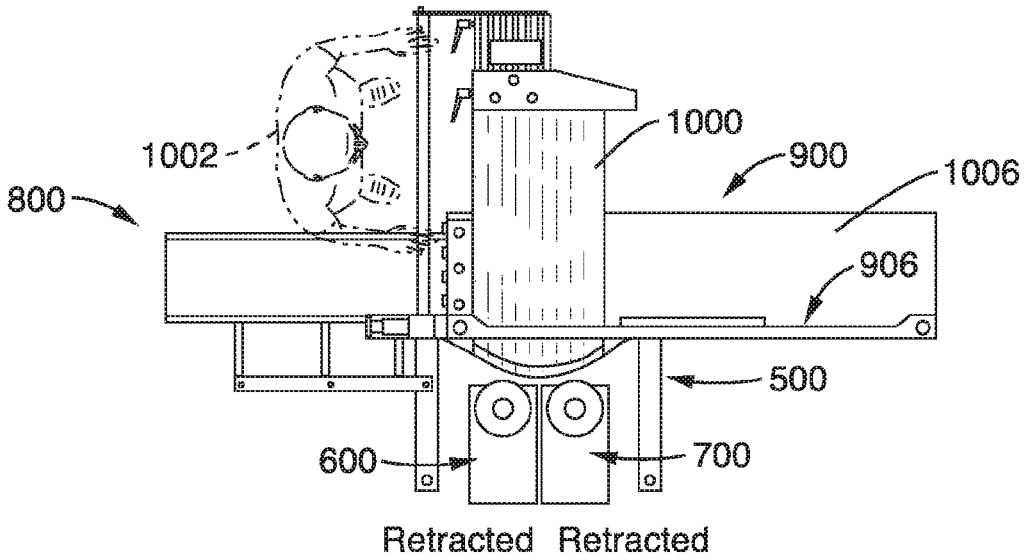

FIG. 10E is a top view of the single setup shaper sander 500 previously described in FIG. 5A through FIG. 5C, where an operator is repeatedly sanding the substrate to a desired smoothness in a single setup.

DETAILED DESCRIPTION OF THE INVENTION

Figure 1A:
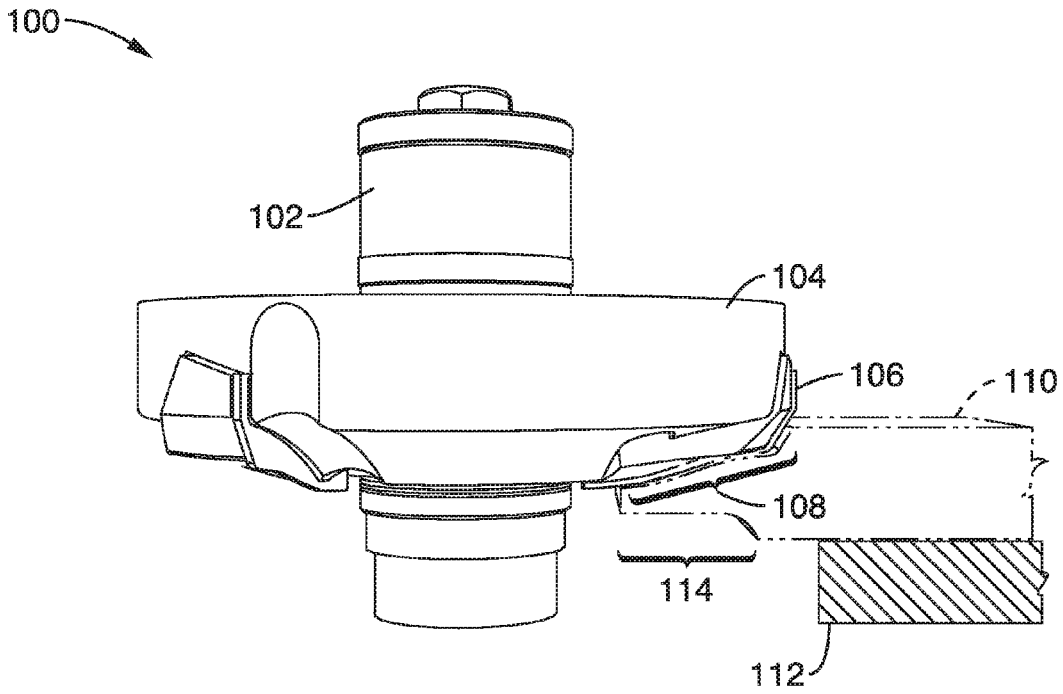
FIG. 1A (Prior Art)
FIG. 1A is an isometric view of a prior art shaper with a permanently affixed tool that cuts a profile in a substrate.

Refer now to FIG. 1A, which is a perspective view of a prior art shaper 100 that comprises a spindle 102 with a permanently affixed shaper tool 104 mounted to the spindle 102. When the spindle 102 is turning, the shaper tool 104 then is able to cut, with cutting inserts 106 a profile 108 in a substrate 110. The substrate 110 is typically placed upon a stationary table 112. The substrate 110 may be wood, a plastic, or other material capable of being cut by the cutting inserts 106. In this figure, the substrate 110 already has a previous profile 114 cut into it.

Although FIG. 1A shows a prior art permanently affixed tool 104 mounted to the spindle 102, a quick change tool may alternatively be used.

Figure 1B:
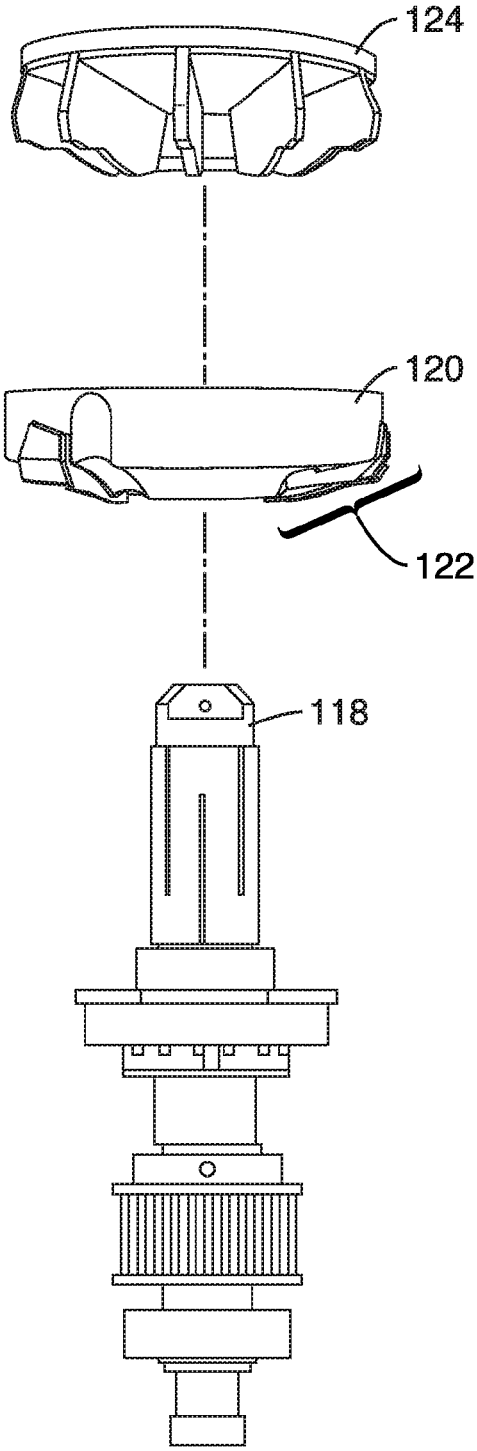
FIG. 1B (Prior Art)
FIG. 1B is an isometric assembly view of the spindle previously shown in FIG. 1A with the detached quick change shaper tool capable of cutting a profile in a substrate, as well as a quick change sander matching the profile formed by the quick change tool.

Refer now to both FIG. 1A and FIG. 1B. Here, FIG. 1B is an assembly view of a quick change spindle 118, where a detachable quick change shaper tool 120 is capable of cutting a profile 122 in the substrate 110. If sanding is required, then a detachable quick change sander tool 124 matching the profile 122 of the detachable quick change shaper tool 120 is used.

In the assembly view of FIG. 1B, it is apparent that the same spindle 118 may be used interchangeably with either the detachable quick change shaper tool 120 or the detachable quick change sander tool 124. Furthermore, matching shaper/sander profiles may be developed for a large variety of profiles.

Figure 2:
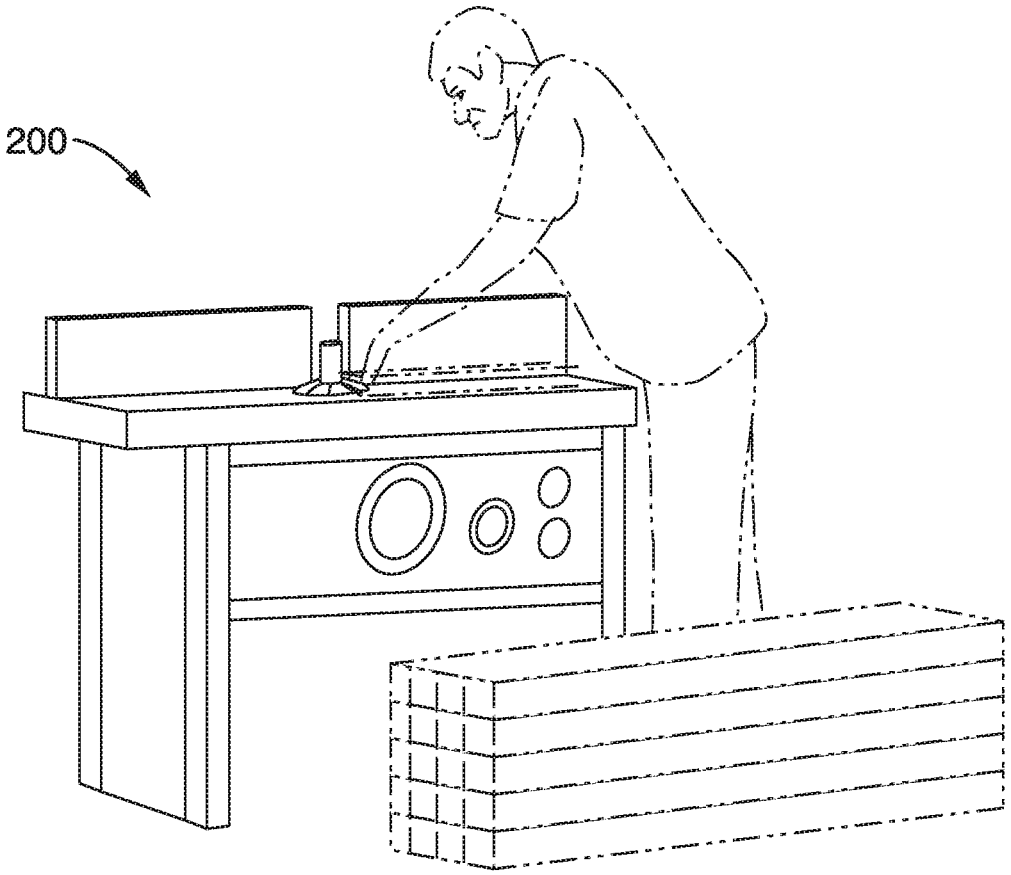
FIG. 2 (Prior Art)
FIG. 2 is front perspective view of an operator working a substrate on a prior art shaper device with a fixed cutting tool.

Refer now to FIG. 2, which is a front perspective view of an operator working a substrate on a prior art shaper device 200. This prior art shaper 200 does not have a sanding capability.

Figure 3A:
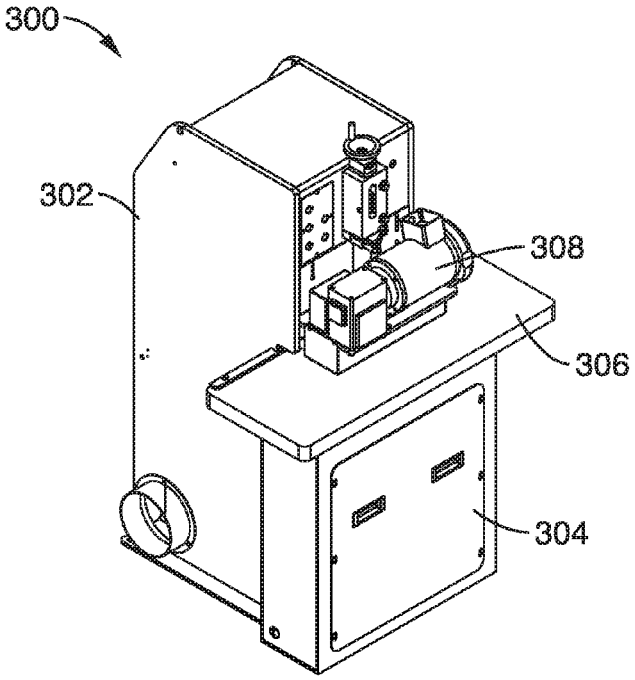
FIG. 3A (Prior Art)
FIG. 3A is an isometric view of a prior art single station table shaper, with an electrical cabinet area below the active table area.

Refer now to FIG. 3A, which is an isometric perspective view of a prior art single station table shaper 300, with a frame 302 having a recessed electrical cabinet area 304 below the table 306 area. Here, the table 306 is stationary, and generally made from cast iron. This particular device also has a power feed 308.

Figure 3B:
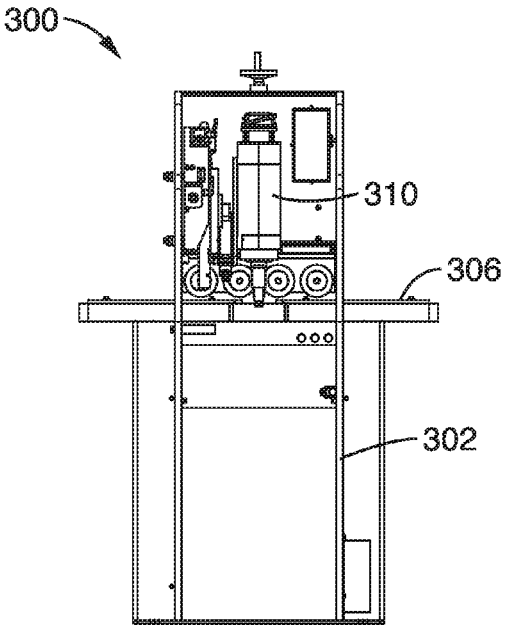
FIG. 3B (Prior Art)
FIG. 3B is a rear view of the prior art single station table shaper of FIG. 3A.

Refer now to FIG. 3B, which is a rear view of the prior art single station table shaper 300 of FIG. 3A. Here, a fixed shaper 310 is the cutting tool used for shaping a profile in a work piece that is placed upon the table 306.

Figure 4A:
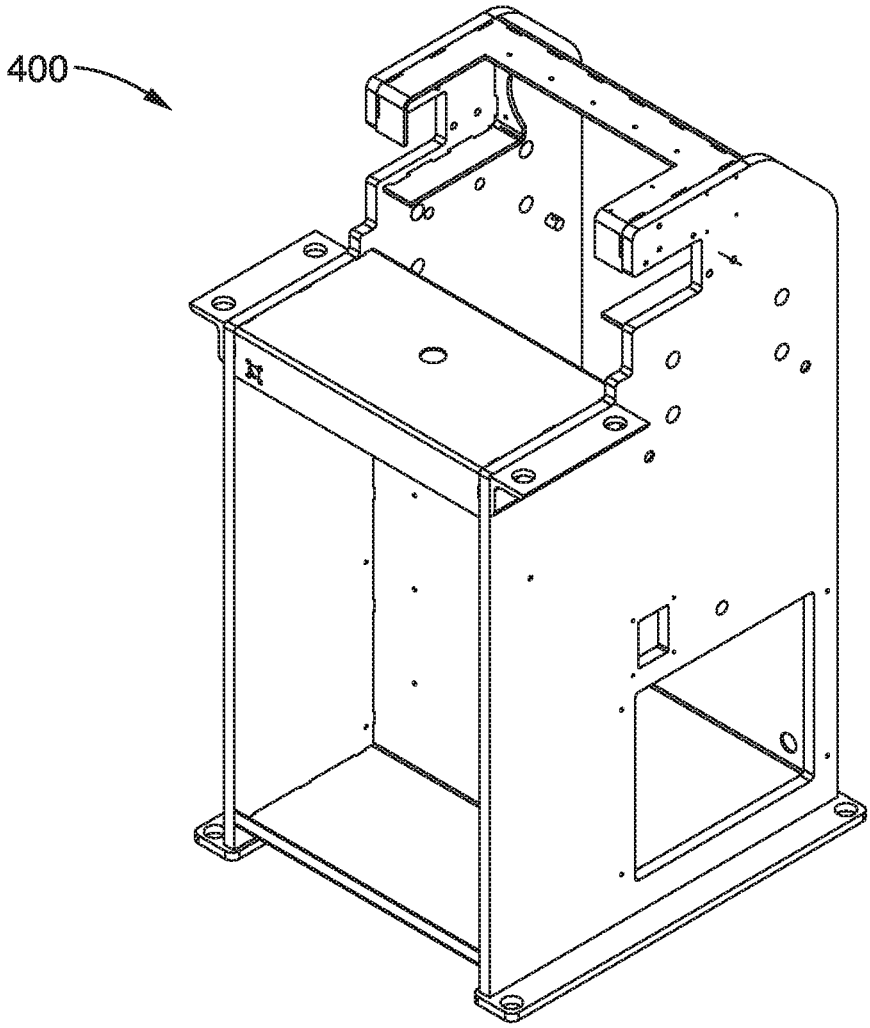
FIG. 4A is an isometric view of a single setup shaper sander frame, which uses modifications of the frame of FIG. 3A and FIG. 3B to allow for simultaneous retractable mounting of both a shaper and sanding tool, where the shaper and sander may be independently retracted.

Refer now to FIG. 4A, which is an isometric view of a single setup shaper sander frame 400, which uses modifications of the frame 302 of FIG. 3A and FIG. 3B to allow for simultaneous retractable mounting of both a shaper and sanding tool, where the shaper and sander may be independently retracted.

Figure 4C:
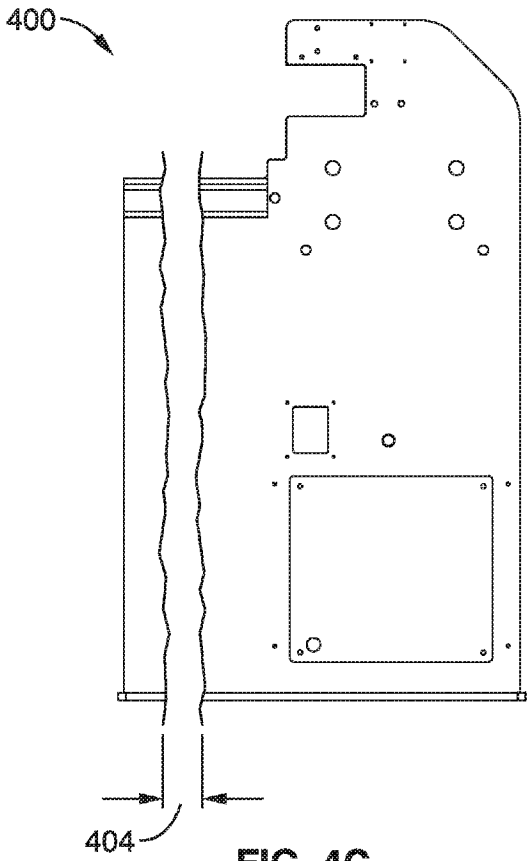
FIG. 4C is a right side view of the single setup shaper sander frame of FIG. 4A, indicating where the frame depth has been deepened to allow room for a rail assembly to be mounted.
Figure 4B:
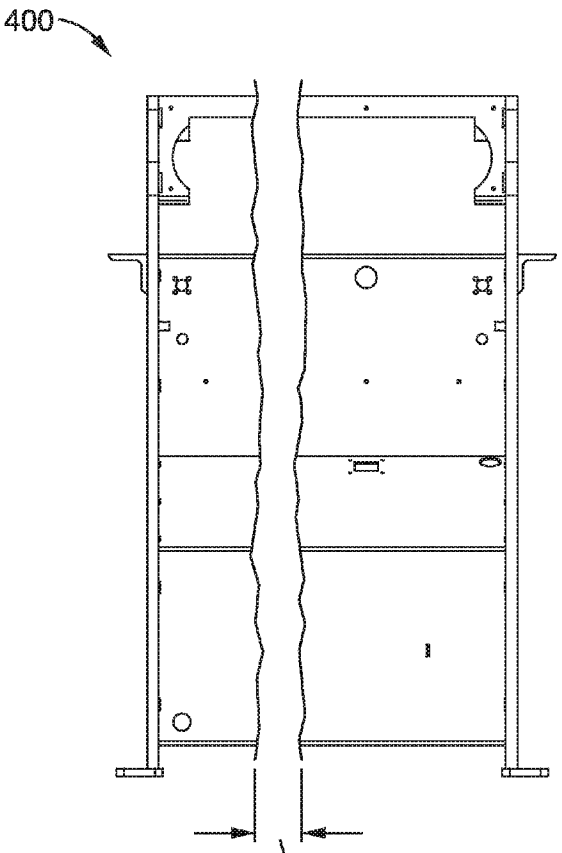
FIG. 4B is a rear view of the single setup shaper sander frame of FIG. 4A, indicating where the frame width has been widened to allow room for a sander to be mounted in addition to the shaper.

Refer now to FIG. 4B, which is a rear view of the single setup shaper sander frame 400 of FIG. 4A, indicating where the frame width has been widened 402 to allow room for a sander to be mounted in addition to the shaper.

Refer now to FIG. 4C, which is a right side view of the single setup shaper sander frame 400 of FIG. 4A, indicating where the frame depth has been deepened 404 to allow room for a rail assembly to be mounted.

Refer now to FIG. 5A, which is a rear isometric view of a single setup shaper sander 500, which uses the modified frame 400 of FIG. 4A through FIG. 4C to allow for simultaneous mounting of both a retractable quick change shaper assembly 600 and a retractable quick change sander assembly 700. Also present is the rail assembly 800 attached to the modified frame 400, and a sliding table assembly 900 slidably attached to the rail assembly 800.

Refer now to FIG. 5B, which is a front isometric view of the single setup shaper sander 500 of FIG. 5A. Here, one may view the front of the modified frame 400, which provides tool shelving 502 for the various shapers and sanders (previously shown in FIG. 1B) used in the single setup shaper sander 500. This front view allows for better viewing of the rail assembly 800 attached to the modified frame 400, as well as the sliding table assembly 900 slidably attached to the rail assembly 800. It is apparent from this view that the sliding table assembly 900 translates in an $\vec{X}$ direction 504 along the rail assembly 800.

Refer now to FIG. 5C, which is a partially exploded rear isometric view of the single setup shaper sander 500 of FIG. 5A and FIG. 5B, where a quick change retractable shaper 600, a quick change retractable sander 700, a rail assembly 800 are shown detached from the modified frame 400. Here the sliding table assembly 900, has had an optional size square assembly 506 attached to it.

Although not detailed at this time, the optional size square assembly 506 is capable of translation in a $\vec{Y}$ direction 508 by following a removable template 510 as the sliding table assembly 900 travels along the $\vec{X}$ direction 504 along the rail assembly 800. In this manner, the sliding table assembly 900 essentially achieves precise two dimensional profile cutting and sanding by following the template 510.

By mounting a substrate (not shown) on the sliding table assembly 900 with the optional size square assembly 506, if the quick change retractable shaper 600 is in the engaged position, the profile will be cut in the substrate. Similarly, if the quick change retractable sander 700 is in the engaged position, the profile will be precision sanded in the substrate. This will be better appreciated later during the description of FIG. 10A through FIG. 10E below.

Figure 6A:
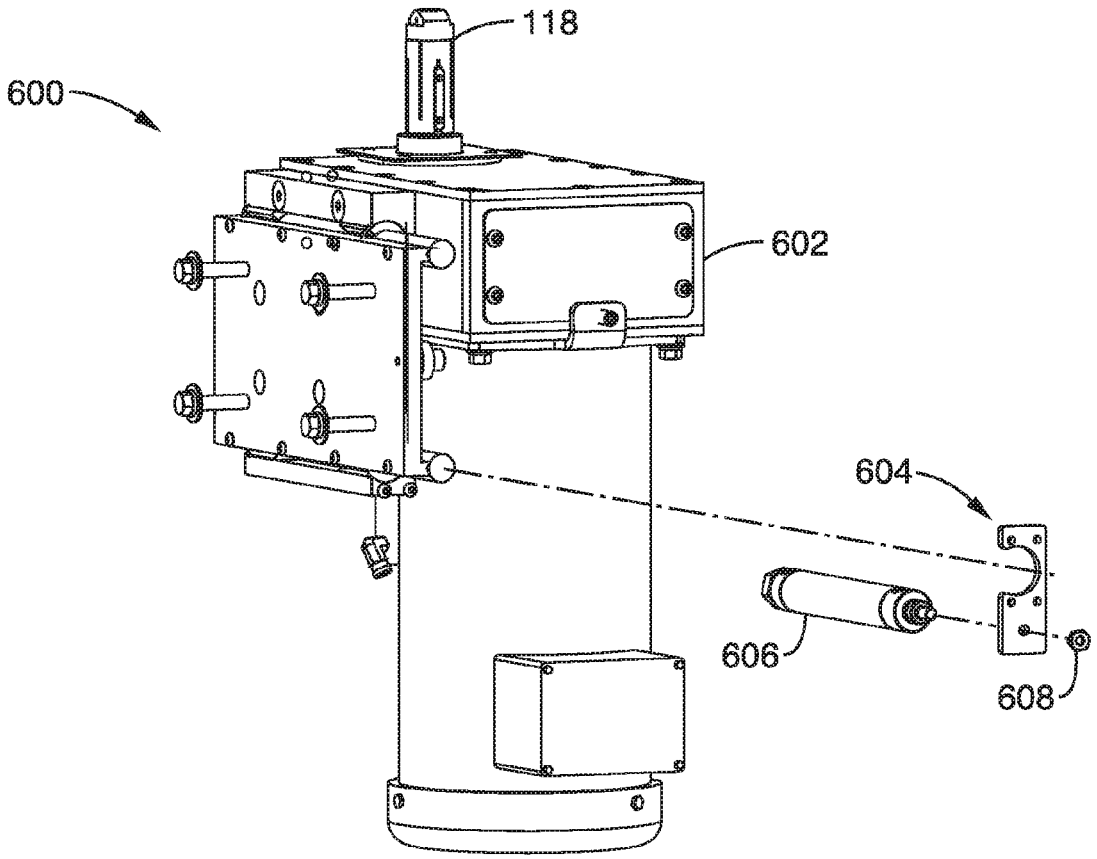
FIG. 6A is an isometric partial assembly view of the quick change retractable shaper of FIG. 5A through FIG. 5C, showing the retractable quick change shaper with an air cylinder actuator and a cylinder mount.

Refer now to FIG. 6A, which is an isometric partial assembly view of the quick change retractable shaper 600 of FIG. 5A through FIG. 5D, showing a modified shaper 602 with a cylinder mount 604 and an air actuator cylinder 606. The cylinder mount 604 attaches to the modified shaper 602 so as to actuate the modified shaper 602 between an extended and a retracted position. This actuation is accomplished via the air cylinder 606, which attaches to the cylinder mount 604 via air cylinder mounting nut 608 on one end, and to the modified frame 400 (not shown here of FIG. 4A through FIG. 5C) on the other end.

Figure 6B:
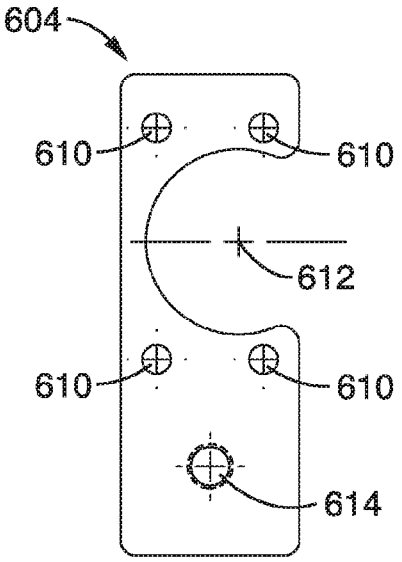
FIG. 6B is a detailed top view of the cylinder mount of FIG. 6A.

Refer now to FIG. 6B, which is a detailed top view of the cylinder mount 604 of FIG. 6A. The cylinder mount 604 has one or more mounting holes 610 to allow for a threaded mounting to the modified shaper 602. The cylinder mount 604 is generally 0.250" thick aluminum. A clearance hole 612 allows for the clearance of a rail (to be described later). Another hole 614 provides for the mounting of one end of the air cylinder 606.

Figure 6C:
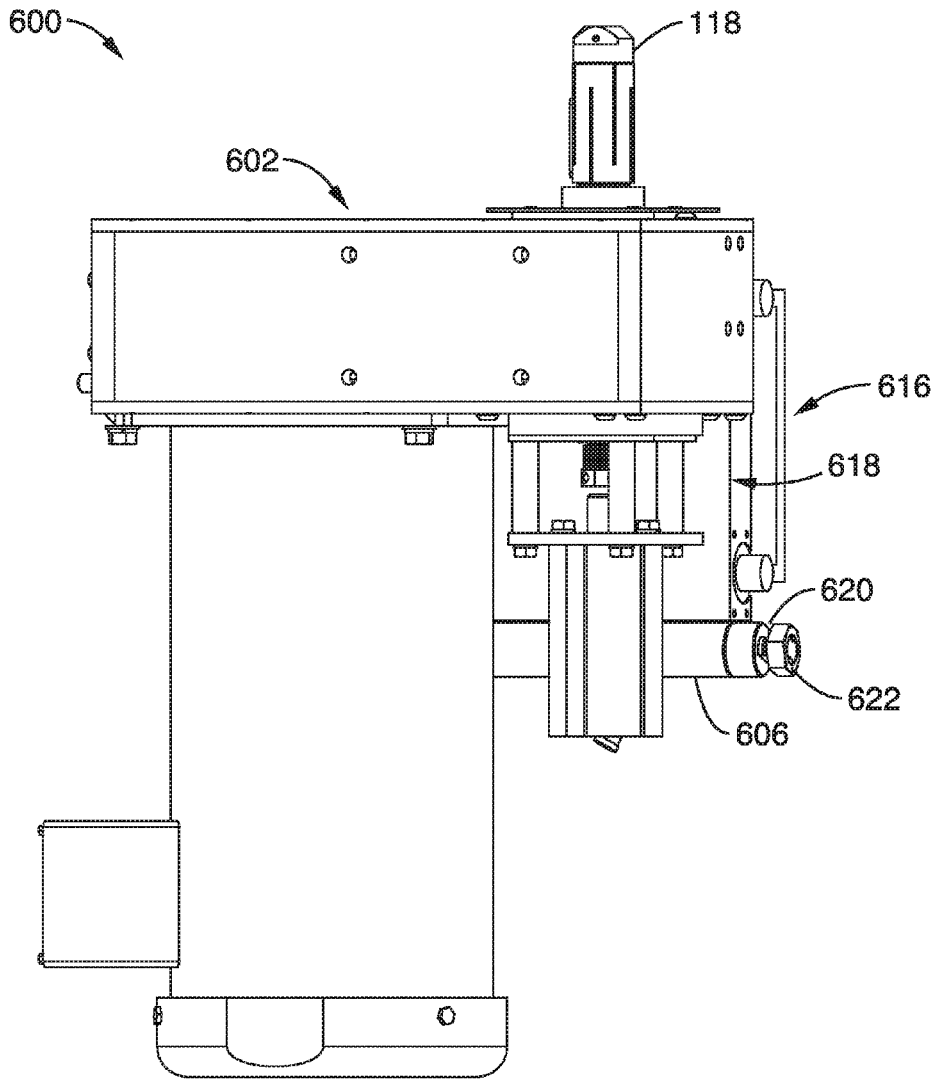
FIG. 6C is a side view of the fully assembled quick change retractable shaper of FIG. 6A, ready for mounting to the frame.

Refer now to FIG. 6C, which is a side view of the fully assembled retractable quick change shaper 600 of FIG. 6A. Here, we see a carriage rail assembly 616 ready for mounting to the single setup shaper sander frame 400 (not shown here). A carriage mount plate 618 is mounted to the modified shaper 602 to provide for translational motion between the carriage mount plate 618 and the carriage rail assembly 616 through actuation of the air cylinder 606 as it attaches through the single setup shaper sander frame 400 (not shown here) at its other end 620 with another nut 622.

Figure 6D:
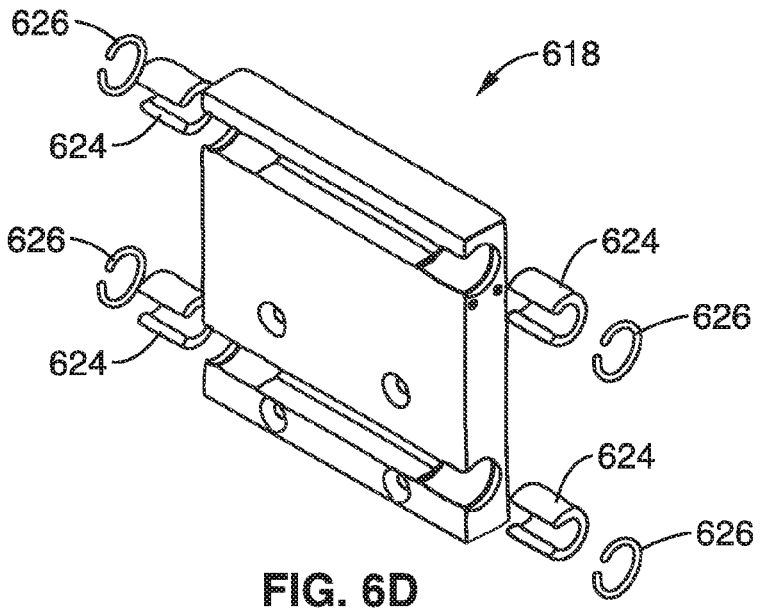
FIG. 6D is an isometric assembly view of the carriage mount plate, which is previously shown attached to the retractable shaper of FIG. 6A and FIG. 6C.

Refer now to FIG. 6D, which is an isometric assembly view of the carriage mount plate 618, and previously shown attached to the retractable quick change shaper of FIG. 6A and FIG. 6C. Here, VXB SW12-OP ¾" Linear Ball Bushings 624 (VXB.com Ball Bearings, NationSkander California Corp., 2165 S Dupont Dr. Unit F, Anaheim Calif. 92806, USA) are retained in the carriage mount plate 618 by spiral internal snap rings 626 UR-125 (American Ring & Tool Company, 30450 Bruce Industrial Pkwy, Solon, Ohio 44139).

Figure 6E:
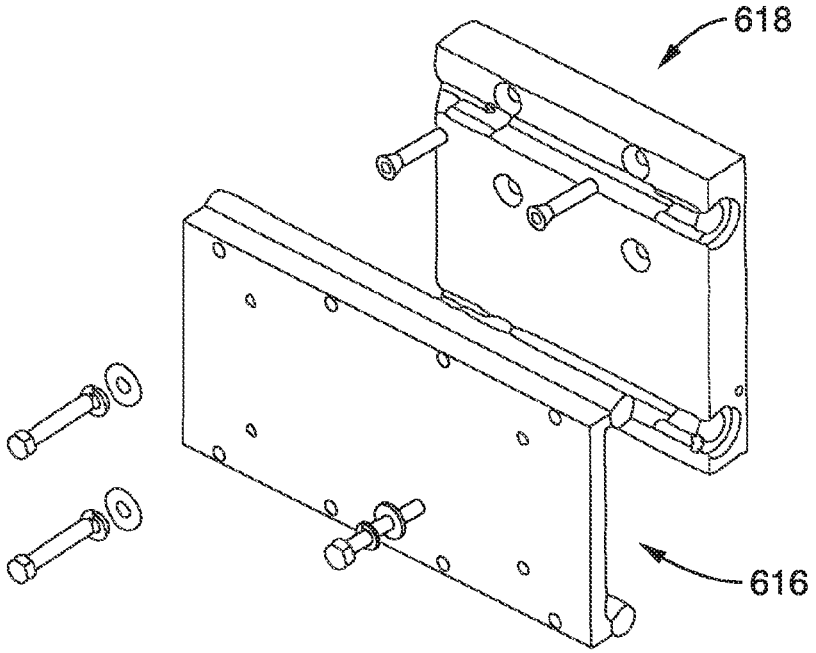
FIG. 6E is an isometric assembly view of the carriage mount plate of FIG. 6A and FIG. 6D, as well as a carriage rail assembly.

Refer now to FIG. 6E, which is an isometric assembly view of the carriage mount plate 618 of FIG. 6D and the carriage rail assembly 616.

Figure 6F:
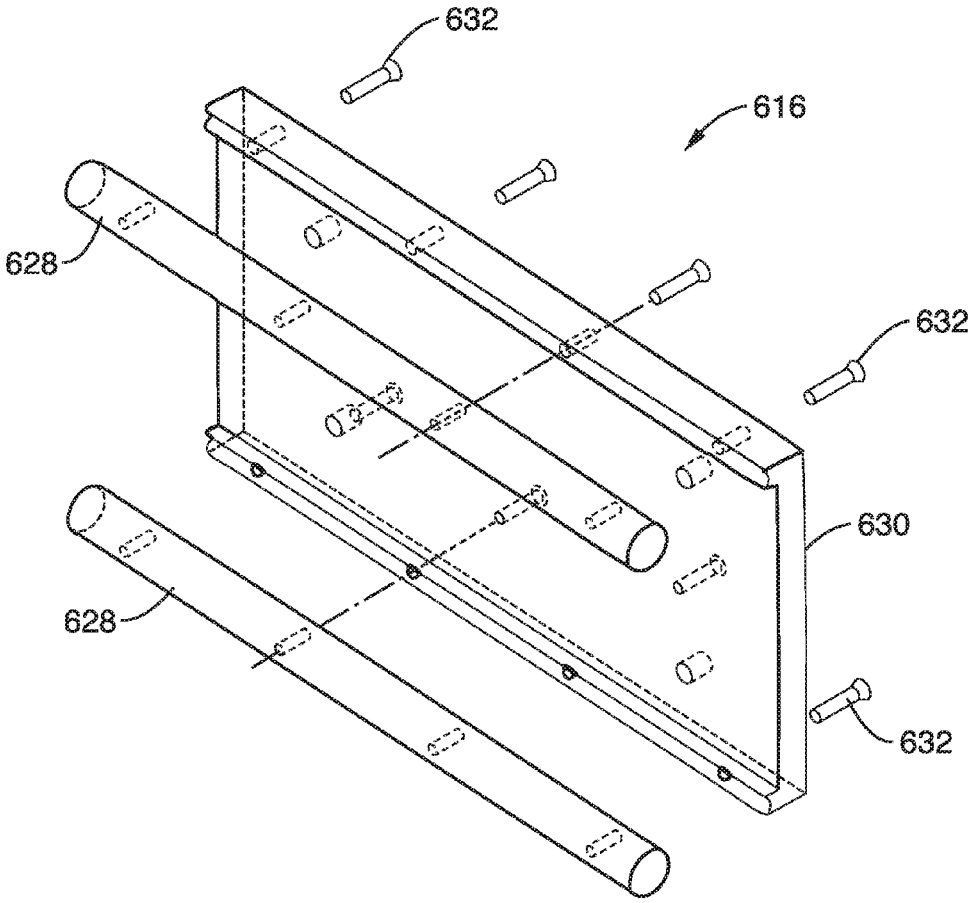
FIG. 6F is an isometric assembly view of the carriage rail assembly of FIG. 6E.

Refer now to FIG. 6F, which is an isometric assembly view of the carriage rail assembly 616 of FIG. 6E. Here, rails 628 are attached to a traverse plate 630 by flat head screws 632.

Figure 7:
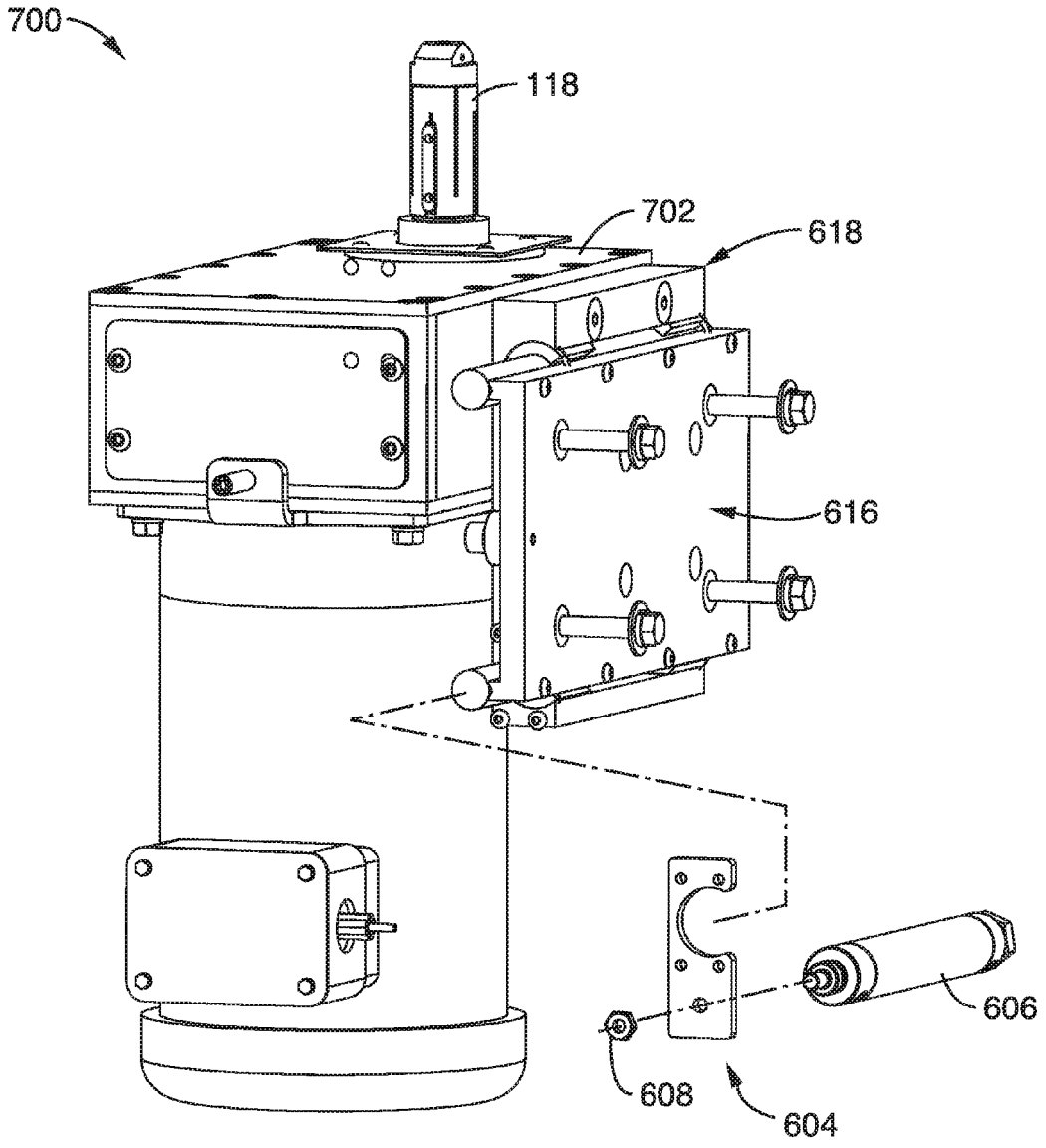
FIG. 7 is an isometric partial assembly view of the retractable sander assembly of FIG. 5A through FIG. 5 C, showing the retractable quick change sander with an air actuator cylinder, cylinder mount, carriage mount plate, and carriage rail assembly.

Refer now to FIG. 7, which is an isometric partial assembly view of the retractable sander assembly of FIG. 5A through FIG. 5D, showing the retractable quick change sander 700 with a carriage mount plate 618 mounted to the modified sander 702 to provide for translational motion between the carriage mount plate 618 and the carriage rail assembly 616 through actuation of the air cylinder 606 as it attaches through the single setup shaper sander frame 400 (not shown here).

Figure 8A:
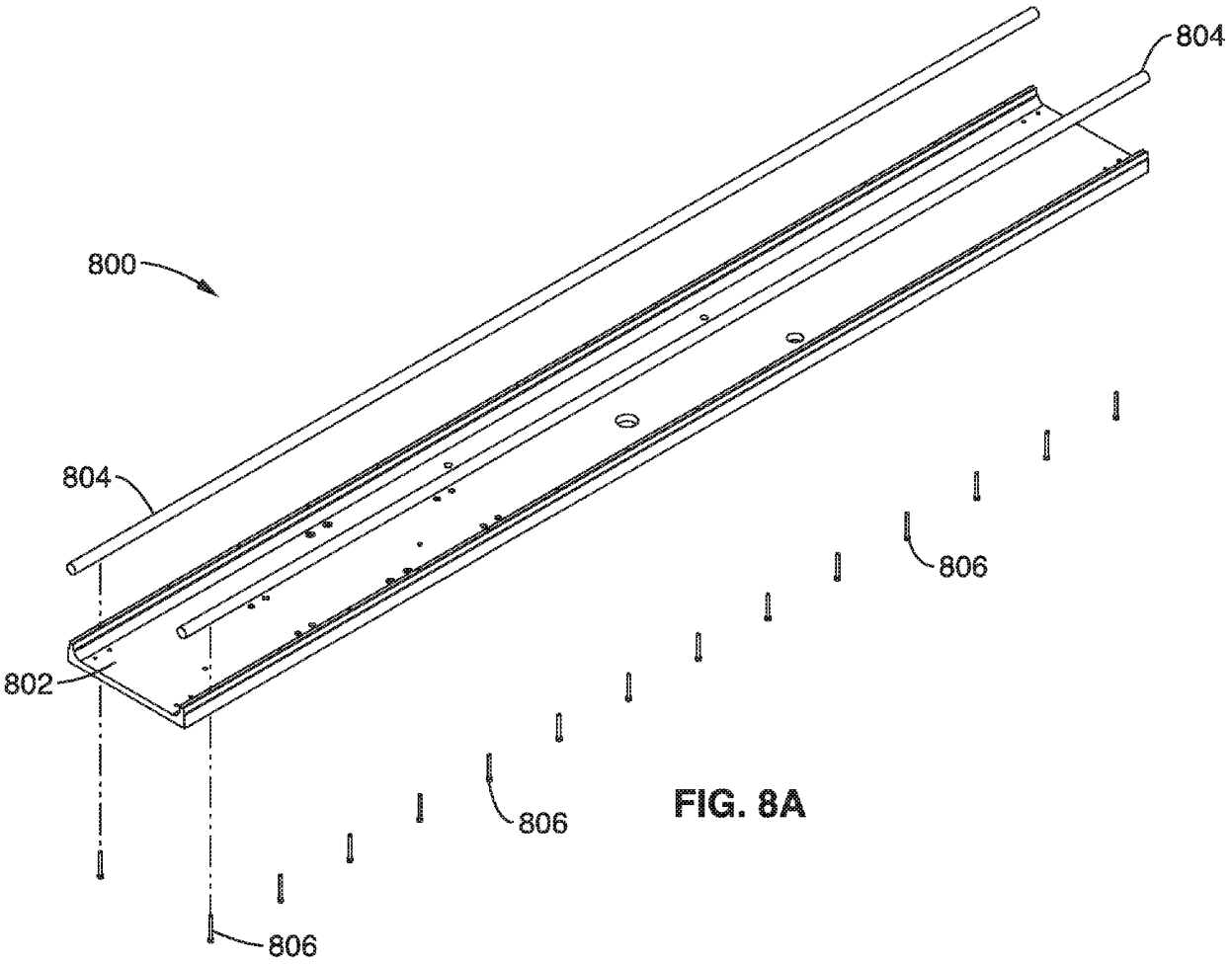
FIG. 8A is an isometric assembly view of a rail assembly, as previously shown assembled in FIG. 5A through FIG. 5C.

Refer now to FIG. 8A, which is an isometric assembly view of a rail assembly 800, as previously shown assembled in FIG. 5A through FIG. 5D. Here, a rail channel 802 is used as a mounting base for rails 804 that are secured through a series of rail mounting screws 806.

Figure 8B:
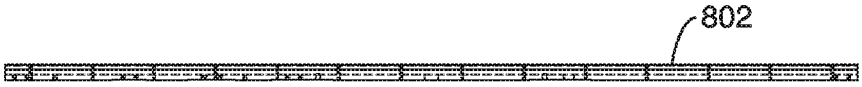
FIG. 8B is side view of a rail channel, which is used as a mounting base in the rail assembly of FIG. 8A.

Refer now to FIG. 8B, which is a side view of a rail channel 802, which is used as a mounting base in the rail assembly of FIG. 8A. The rail channel 802 is basically a long straight geometry in this view.

Figure 8C:
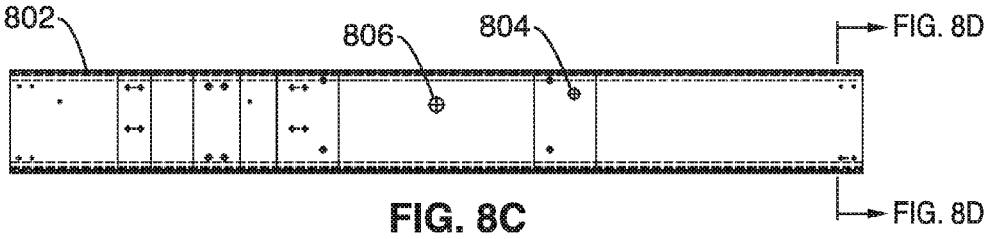
FIG. 8C is a top view of the rail channel of FIG. 8B.

Refer now to FIG. 8C, which is a top view of the rail channel 802 of FIG. 8B. Precision referencing holes 804 and 806 are used to locate the rail channel 802 relative to the single setup shaper sander modified frame 400 (not shown here).

Figure 8D:
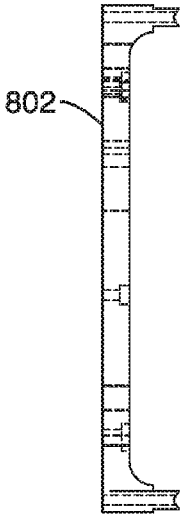
FIG. 8D is a cross-sectional view of the rail channel of FIG. 8C.

Refer now to FIG. 8D, which is a cross-sectional view of the rail channel 802 of FIG. 8C. Here we see that the rail channel 802 is actually more of a U-shaped geometry.

Figure 8E:
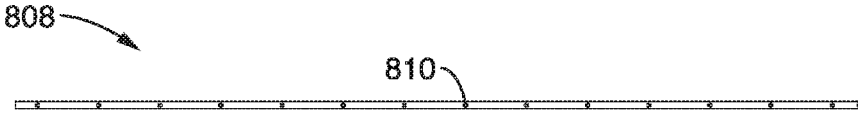
FIG. 8E is a bottom view of the rail of FIG. 8A.

Refer now to FIG. 8E, which is a top view of the rails 808 of FIG. 8A. Here, the 0.750" rail 808 is shown with a series of blind threaded holes 810 for mounting. These blind threaded holes 810 have a diameter of 0.150" to a depth of 0.589", and are tapped 10-24 UNC to a depth of 0.380".

Figure 9A:
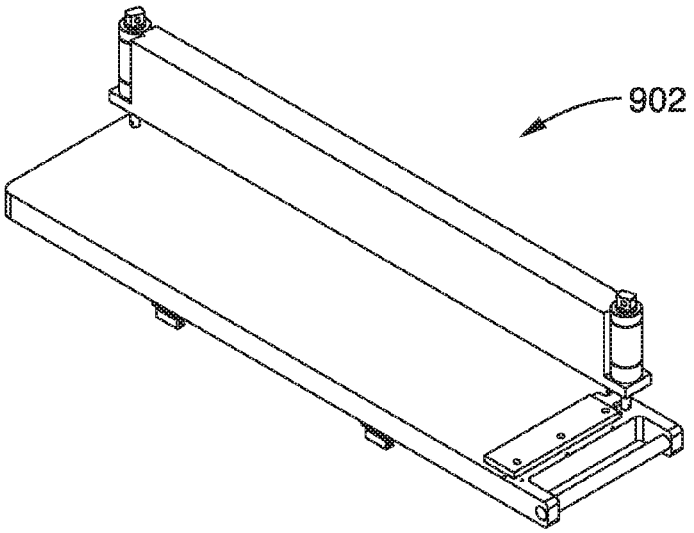
FIG. 9A is an isometric view of a sled assembly without the size square assembly previously shown in FIG. 5A through FIG. 5C.

Refer now to FIG. 9A, which is an isometric view of a sled assembly 902 (without the size square feature 506 previously shown in FIG. 5A through FIG. 5C) that traverses the rail assembly 800 (not shown here) of FIG. 8A.

Figure 9B:
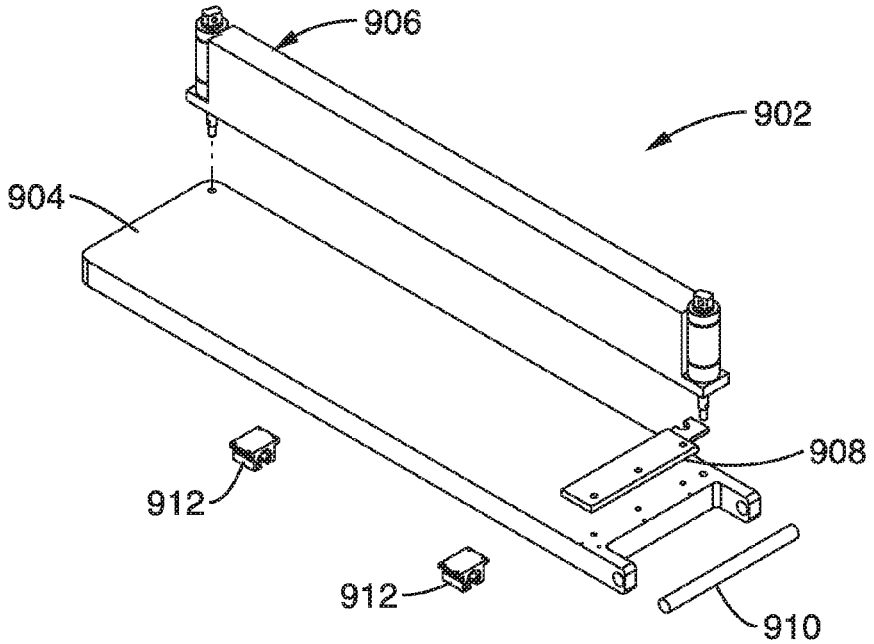
FIG. 9B is a partially assembly isometric view the sled assembly of FIG. 9A.

Refer now to FIG. 9B, which is a partially assembly isometric view the sled assembly 902 of FIG. 9A. Here, a table surface plate 904 forms the base of the sled assembly 902. To the table surface plate 904 is attached a hold down assembly 906. A square fence 908 is used to position work pieces so that they are perpendicular to the direction of motion (as shown previously in FIG. 5B) of the sled assembly 902. A table handle 910 serves as a convenient place for a worker to move the sled assembly 902 forward and backward as they slide via linear bushings 912 over the rails 804 of rail assembly 800.

Figure 9C:
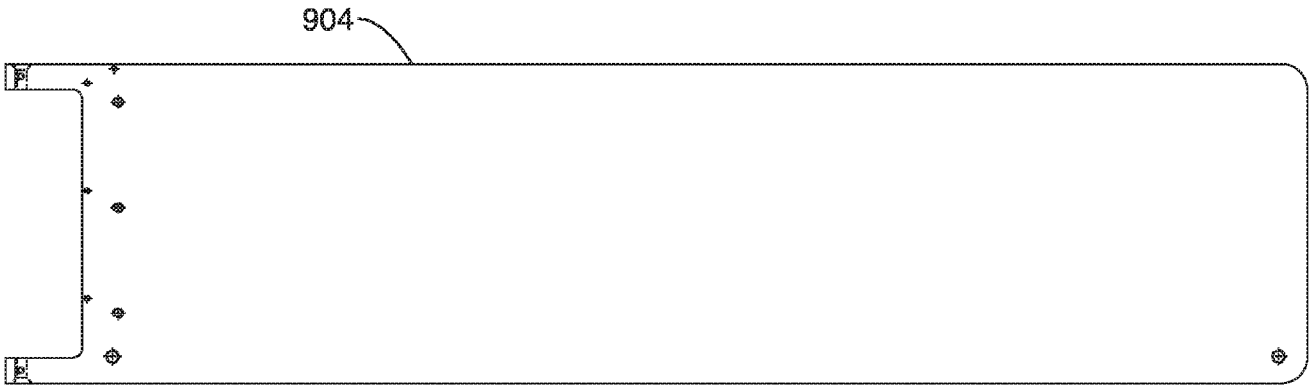
FIG. 9C is a top view of the table surface plate of FIG. 9B.
Figure 9D:
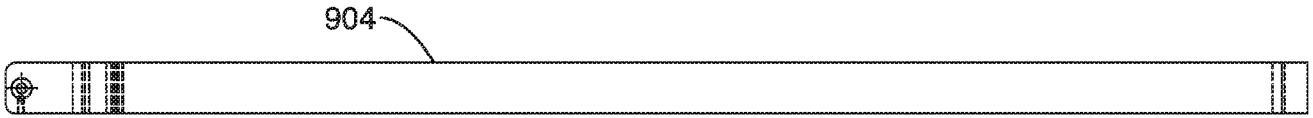
FIG. 9D is a side view of the table surface plate of FIG. 9B.

Refer now to FIG. 9C and FIG. 9D, which are respectively a top view and a side view of the table surface plate 904 of FIG. 9B.

Figure 9E:
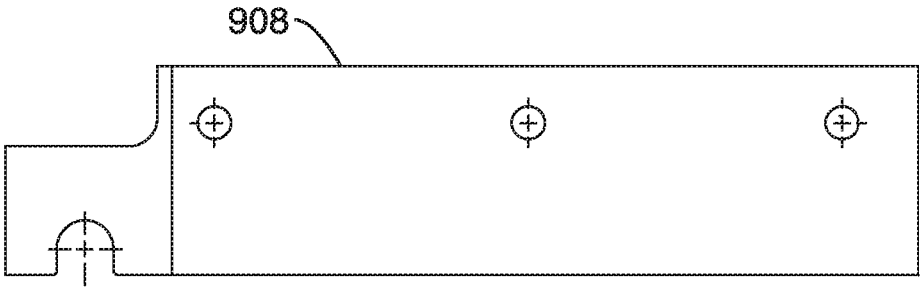
FIG. 9E is a top view of the table fence of the sled assembly of FIG. 9B.
Figure 9F:
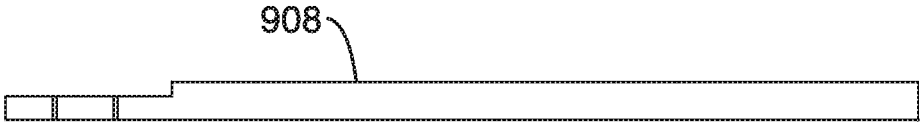
FIG. 9F is a side view of the table fence of the sled assembly of FIG. 9B.

Refer now to FIG. 9E and FIG. 9F, which are respectively a top view and a side view of the table fence 908 of the sled assembly 902 of FIG. 9B.

Figure 9G:
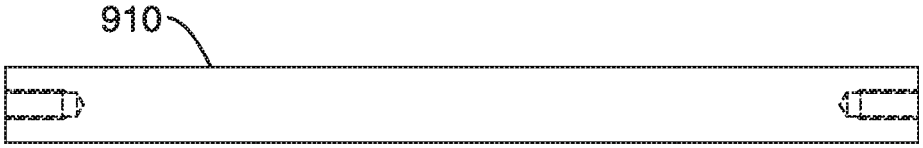
FIG. 9G is a top view of the table handle of the sled assembly of FIG. 9B.

Refer now to FIG. 9G, which is a top view of a table handle 910 of the sled assembly 902 of FIG. 9B. The table handle 910 is shown as cylindrical, although it may be any other geometry comfortably conforming to a hand for holding.

Figure 9H:
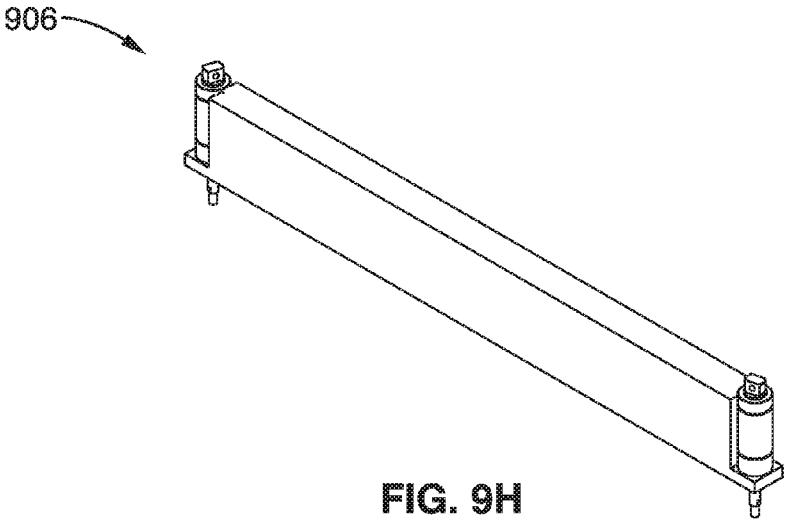
FIG. 9H is an isometric view of the hold down assembly of the sled assembly of FIG. 9B.

Refer now to FIG. 9H, which is an isometric view of the hold down assembly 906 of the sled assembly 902 of FIG. 9B.

Figure 9I:
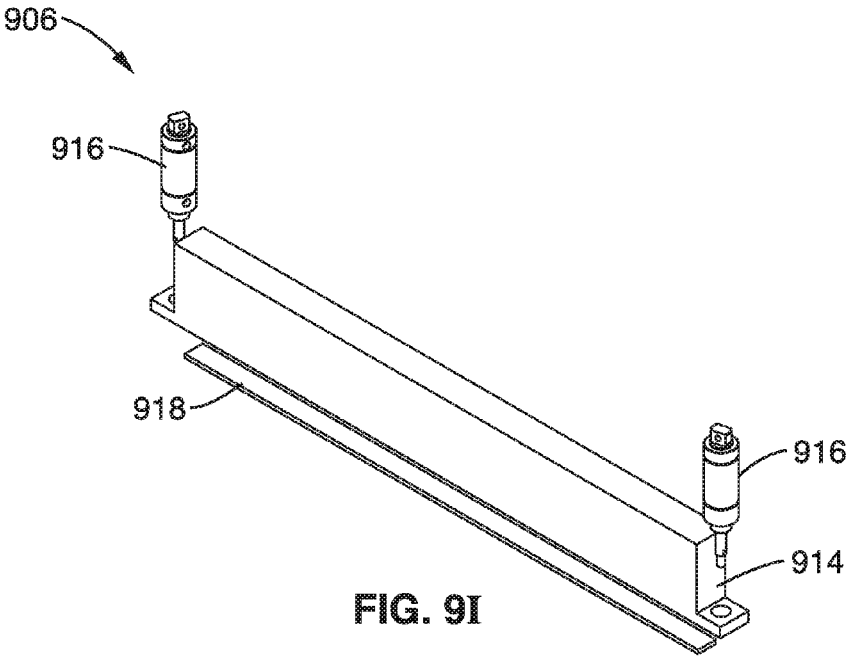
FIG. 9I is an isometric partial assembly view of the hold down assembly of FIG. 9H.

Refer now to FIG. 9I, which is an isometric partial assembly view of the hold down assembly 906 of FIG. 9H. Here, a hold down frame 914 is actuated by actuators 916, such as BIMBA-311.5-DXP air actuators (Bimba Manufacturing Company, P. O. Box 68, Monee, Ill., 60449-0068), to cause movement up or down of the hold down frame 914. When a work piece or substrate (not shown) is placed between the hold down frame 914, hold down belt 918 and the table surface plate 904 (of FIG. 9B), then the actuators 916 serve to hold the work piece in place, relative to the table surface plate 904. The hold down belt 918 may preferably be glued to the hold down frame 914 to preclude marring of a relatively soft work piece.

Figure 9J:
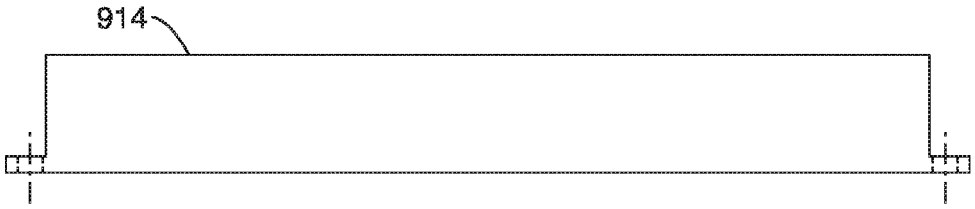
FIG. 9J is a side view a hold down frame of the sled assembly of FIG. 9A.
Figure 9K:
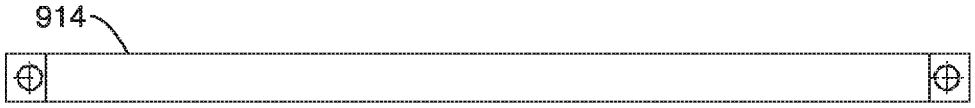
FIG. 9K is a top view the hold down frame of FIG. 9I.
Figure 9L:
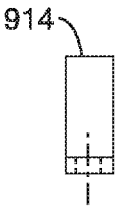
FIG. 9L is an end view the hold down frame of FIG. 9I.

Refer now to FIG. 9J through FIG. 9L, which are respectively a side view, a top view, and an end view of the hold down frame 914 of FIG. 9I.

Refer now to FIG. 10A through FIG. 10E, which are sequential frames of usage of the single setup shaper sander 500 previously described in FIG. 5A through FIG. 5C. Note that in this series, the size square feature 506 of FIG. 5C is used, as opposed to the previous set of figures, FIG. 9A through FIG. 9L, where the size square feature 506 was not present.

In FIG. 10A, a substrate 1000 is positioned in the single setup shaper sander 500. Since the sliding table assembly 900 is slidably attached to the rail assembly 800, then when the operator 1002 moves the substrate 1000 forward, multiple and accurate sanding passes may be made after the shaping process. Protective cover 1004 protects the operator 1002 from the sharp spinning surfaces of the retractable quick change shaper assembly 600, and the retractable quick change sander assembly 700.

The substrate 1000 is positioned on the sliding table assembly 900 by a hold down assembly 906. The hold down assembly 906 clamps the substrate 1000 securely to the sliding table assembly 900 and also acts as a protective barrier, shielding the operator 1002 from the rotating tools covered by the protective cover 1004. When the operator 1002 pushes on the sliding table assembly 900, the rail assembly 800 guides the sliding table assembly 900 in a desired back and forth direction that is tangent to the retractable quick change shaper assembly 600, and the retractable quick change sander assembly 700. The sliding table assembly 900 restricts the table 1006 from moving in any other direction then what is desired for accurate shaping or sanding.

In FIG. 10B, before cutting the substrate (typically, but not exclusively wood), the operator 1002 positions the retractable quick change shaper assembly 600 in the extended or cutting position.

In FIG. 10C, the operator has pushed the substrate 1000 past the retractable quick change shaper assembly 600 and a cut has been made in the substrate 1000. Since the retractable quick change sander assembly 700 is also engaged, sanding of the profile is also taking place. In this manner, with a single forward motion, the operator 1002 achieves both profiling, and a first pass of sanding.

In FIG. 10D, the operator 1002 then retracts the retractable quick change shaper assembly 600 away from the engaged cutting position allowing the operator 1002 to move the substrate 1000 back and forth in front of the retractable quick change sander assembly 700, without having the substrate 1000 be cut once again by the retractable quick change shaper assembly 600, and thereby possibly marking the substrate 1002 after sanding.

In FIG. 10E, the operator 1002 can optionally repeat the back and forth motion in front of the retractable quick change sander assembly 700 to produce the desired sanding result on the shaped substrate 1000.

From the discussion above it will be appreciated that the invention can be embodied in various ways, including the following:

1. An apparatus for shaping and sanding a substrate, the apparatus comprising: a frame; a shaper attached to the frame, the shaper having a shaper engaged position; and a sander attached to the frame, the sander having a sander engaged position; whereby the shaper cuts a profile in a substrate when the shaper is in the shaper engaged position; whereby the sander sands the profile in the substrate when the sander is in the sander engaged position; and whereby the substrate may be shaped and sanded without intermediate removal of the substrate.

2. The apparatus of any previous embodiment, wherein the shaper is retractable from the shaper engaged position to a shaper retracted position.

3. The apparatus of any previous embodiment, wherein the sander is retractable from the sander engaged position to a sander retracted position.

4. The apparatus of any previous embodiment, wherein the shaper and sander are independently retractable from their respective shaper engaged position and sander engaged position to a respective shaper retracted position and a sander retracted position.

5. The apparatus of any previous embodiment: wherein the substrate is removably affixed to a movable table assembly; whereby the movable table assembly moves the substrate into contact with the shaper to cut the profile; and whereby the movable table assembly moves the substrate into contact with the sander to sand the profile.

6. The apparatus of any previous embodiment, wherein the shaper comprises a removable shaper removably attached to a spindle.

7. The apparatus of any previous embodiment, wherein the sander comprises a removable sander removably attached to a spindle.

8. A shaper sander station, comprising: a frame; means for shaping a profile, said means for shaping attached to the frame; and means for sanding the profile, said means for sanding attached to the frame.

9. The shaper sander station of any previous embodiment, wherein the means for shaping comprises a means for retracting a shaper from a shaper engaged position to a shaper retracted position.

10. The shaper sander station of any previous embodiment, wherein the means for sanding comprises a means for retracting a sander from a sander engaged position to a sander retracted position.

11. The shaper sander station of any previous embodiment, wherein the shaper and sander are independently retractable from their respective shaper engaged position and sander engaged position.

12. The shaper sander station of any previous embodiment: wherein a movable table translates relative to the frame; and wherein a substrate is removably affixed to the movable table; whereby the movable table moves the substrate into contact with the shaper to cut the profile; and whereby the movable sled moves the substrate into contact with the sander to sand the profile.

13. A method for shaping and sanding a substrate, the method comprising: providing a substrate, a retractable shaper and a retractable profile sander; positioning the retractable shaper in a shaper engaged position; positioning the retractable sander in a sander engaged position; moving the substrate past the retractable shaper to generate a profile in the substrate; retracting the retractable shaper to a shaper retracted position; and sanding the profile in the substrate with the retractable sander; whereby the substrate is only removed after the profile has been cut and sanded.

14. A method of shaping and sanding a substrate, the method comprising: providing a retractable shaper; providing a retractable sander; initially mounting a substrate; shaping a profile into the substrate with the retractable shaper; retracting the retractable shaper; and sanding the profile previously shaped in the substrate with the retractable profile sander.

15. The method of any previous embodiment, wherein the substrate is mounted on a sliding table assembly once during the shaping of one edge.

16. The method of any previous embodiment, wherein the retractable shaper is removable and replaceable to allow for different cutting profiles in the work piece.

17. The method of any previous embodiment, wherein the retractable sander is removable and replaceable to allow for different sanding profiles in the work piece.

18. The method of any previous embodiment, wherein the retractable shaper and the retractable sander have the same profile.

19. The method of any previous embodiment, wherein the initial mounting of the substrate step comprises: holding the substrate with a hold down assembly by actuating one or more air cylinders; whereby the air cylinders exert a force on the substrate between a sled assembly and the hold down assembly.

20. The method of any previous embodiment, wherein the sled assembly comprises a size square feature.

Although the description above contains many details, these should not be construed as limiting the scope of the invention but as merely providing illustrations of some of the presently preferred embodiments of this invention. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. An apparatus for shaping and sanding a substrate, the apparatus comprising:

a frame;

a shaper attached to the frame, the shaper having a shaper engaged position; and a sander attached to the frame, the sander having a sander engaged position;

whereby the shaper cuts a profile in a substrate when the shaper is in the shaper engaged position;

wherein the sander sands the profile in the substrate when the sander is in the sander engaged position;

wherein the substrate may be shaped and sanded without intermediate removal of the substrate;

wherein the substrate translates relative to the frame; and wherein the retractable shaper and the retractable sander have the same profile.

2. The apparatus of claim 1, wherein the shaper is retractable from the shaper engaged position to a shaper retracted position.

3. The apparatus of claim 1, wherein the sander is retractable from the sander engaged position to a sander retracted position.

4. The apparatus of claim 1, wherein the shaper and sander are independently retractable from their respective shaper engaged position and sander engaged position to a respective shaper retracted position and a sander retracted position.

5. The apparatus of claim 1:

wherein the substrate is removably affixed to a movable table assembly;

wherein the movable table assembly moves the substrate into contact with the shaper to cut the profile; and wherein the movable table assembly moves the substrate into contact with the sander to sand the profile.

6. The apparatus of claim 5, wherein the shaper comprises a removable shaper removably attached to a spindle.

7. The apparatus of claim 5, wherein the sander comprises a removable sander removably attached to a spindle.

8. A shaper sander station, comprising:

a frame;

a movable table that linearly translates relative to the frame, in an $\vec{X}$ direction;

means for shaping a profile, said means for shaping attached to the frame; and means for sanding the profile, said means for sanding attached to the frame;

wherein the means for shaping the profile comprises a mill;

wherein the means for shaping is actuated by an air cylinder between an extended and a retracted position.

9. The shaper sander station of claim 8, wherein the means for shaping comprises a means for retracting a shaper from a shaper engaged position to a shaper retracted position.

10. The shaper sander station of claim 9, wherein the means for sanding comprises a means for retracting a sander from a sander engaged position to a sander retracted position.

11. The shaper sander station of claim 10, wherein the shaper and sander are independently retractable from their respective shaper engaged position and sander engaged position.

12. The shaper sander station of claim 11:

wherein a substrate is removably affixed to the movable table;

wherein the movable table moves the substrate into contact with the shaper to cut the profile; and wherein the movable table moves the substrate into contact with the sander to sand the profile.

13. An apparatus for shaping and sanding a substrate, the apparatus comprising:

a frame;

a shaper attached to the frame, the shaper having a shaper engaged position; and a sander attached to the frame, the sander having a sander engaged position;

wherein the shaper cuts a profile in a substrate when the shaper is in the shaper engaged position;

wherein the sander sands the profile in the substrate when the sander is in the sander engaged position;

wherein the substrate may be shaped and sanded without intermediate removal of the substrate;

wherein the shaper and the sander have the same profile;

wherein the substrate translates relative to the frame on a movable table; and wherein the substrate is removably clamped to the movable table.

14. The apparatus for shaping and sanding the substrate of claim 13, wherein the shaper and sander are simultaneously engaged with the substrate at the same time.

15. The apparatus for shaping and sanding the substrate of claim 13, wherein the substrate is removably clamped to the movable table by a hold down assembly, and wherein the hold down assembly acts as a protective barrier, shielding an operator from the rotating shaper and sander.

16. The apparatus for shaping and sanding the substrate of claim 13, further comprising:

a template removably attached to the frame, whereby the shaper and sander follow the template when engaged;

wherein the substrate is shaped and sanded following the template.

17. A shaper sander station, comprising:

a frame;

a movable table that linearly translates relative to the frame, in an $\vec{X}$ direction;

means for shaping a profile, said means for shaping attached to the frame; and means for sanding the profile, said means for sanding attached to the frame;

wherein the means for shaping the profile comprises a mill;

wherein the means for shaping is actuated by an air cylinder between an extended and a retracted position; and wherein the means for sanding is actuated by an air cylinder between an extended and a retracted position.

* * * * *